United States Patent [19]

Miller

[11] Patent Number: 4,969,587

[45] Date of Patent: Nov. 13, 1990

[54] PARTITIONED CONTAINERS

[76] Inventor: Keith D. Miller, 11189 Longhill Dr., Pinellas Park, Fla. 34666

[21] Appl. No.: 356,029

[22] Filed: May 23, 1989

[51] Int. Cl.[5] ..... A45F 3/00

[52] U.S. Cl. ..... 224/148; 224/207; 224/257; 132/315; 206/581; 206/823; 220/23

[58] Field of Search ..... 224/148, 202, 207, 257, 224/258, 920; 220/23; 206/77.1, 581, 823; 294/146; 132/314, 315; 215/6

[56] References Cited

U.S. PATENT DOCUMENTS

| | | | |
|---|---|---|---|
| 1,421,645 | 7/1922 | Wilson | 206/823 X |
| 1,466,593 | 8/1923 | Kirchmer, Jr. | 206/77.1 X |
| 1,742,279 | 1/1930 | Reynolds | 206/581 X |
| 2,750,066 | 6/1956 | Shekter | 220/23 |
| 2,919,448 | 1/1960 | Solbach | 220/23 X |
| 3,377,121 | 4/1968 | Billesbach et al. | 206/581 |
| 4,024,731 | 5/1977 | Branscum | 220/23 X |
| 4,280,643 | 7/1981 | Condova et al. | 224/148 X |
| 4,592,478 | 6/1986 | Laconis | 220/23.83 |
| 4,611,716 | 9/1986 | Sorlien | 206/581 |
| 4,621,730 | 11/1986 | Mancusi, Jr. | 206/77.1 |

FOREIGN PATENT DOCUMENTS

| | | | |
|---|---|---|---|
| 546323 | 4/1956 | Belgium . | |
| 3010861 | 10/1981 | Fed. Rep. of Germany | 224/42.42 |
| 436661 | 6/1948 | Italy | 215/6 |
| 616005 | 1/1961 | Italy | 220/23 |
| 293064 | 7/1965 | Netherlands | 206/77.1 |
| 940326 | 10/1963 | United Kingdom | 215/6 |

*Primary Examiner*—Henry J. Recla
*Assistant Examiner*—R. M. Fetsuga
*Attorney, Agent, or Firm*—Joseph C. Mason; Ronald E. Smith

[57] ABSTRACT

A portable container that holds shampoo, hair conditioner and a bar of soap. The container includes three subcompartments, each of which is dedicated to the containment of a particular toiletry item. In a first embodiment, the lid of the container is hollow and is subdivided into compartments for shampoo and hair conditioner and the lid is hingedly connected to the base of the container within which a bar of soap is contained. In a second embodiment, the soap compartment holds the soap on end and the shampoo and hair conditioner are maintained in separate compartments that surmount one end of the soap dish. The containers of both embodiments are provided with an elongate looped rope so that the container may be draped around the neck of a user.

6 Claims, 4 Drawing Sheets

Fig. 4
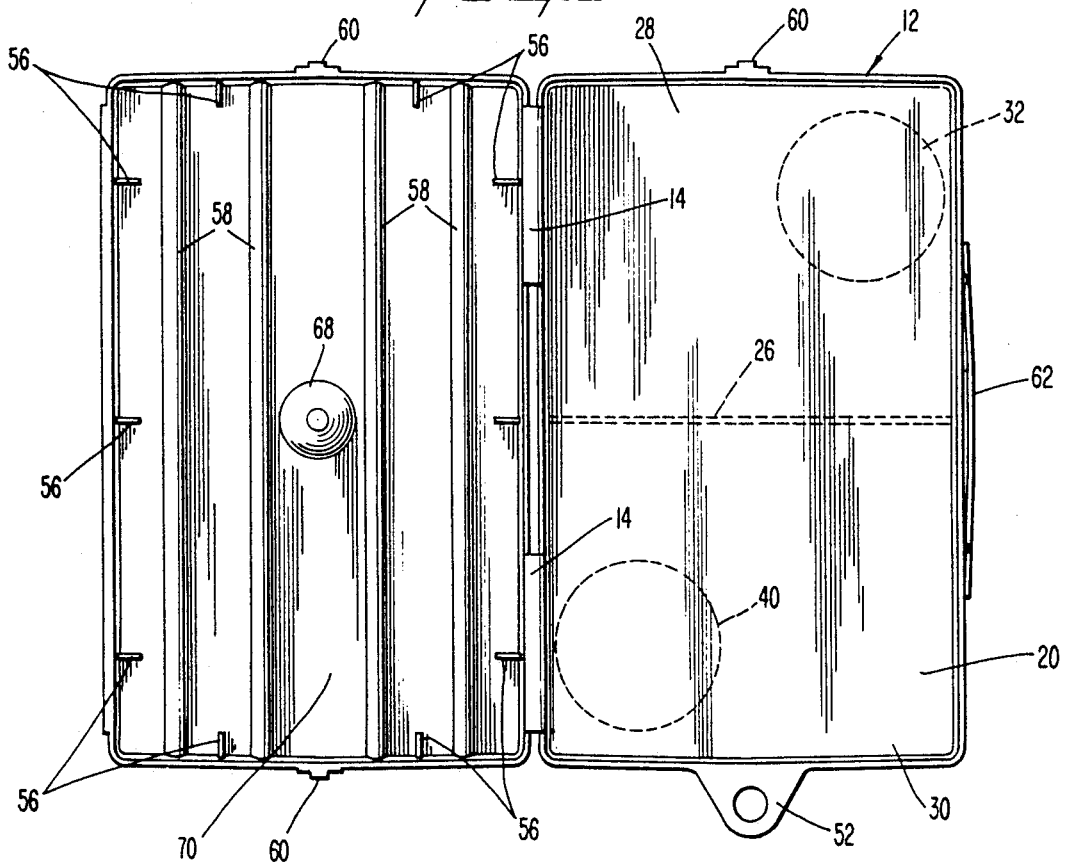
Fig. 5
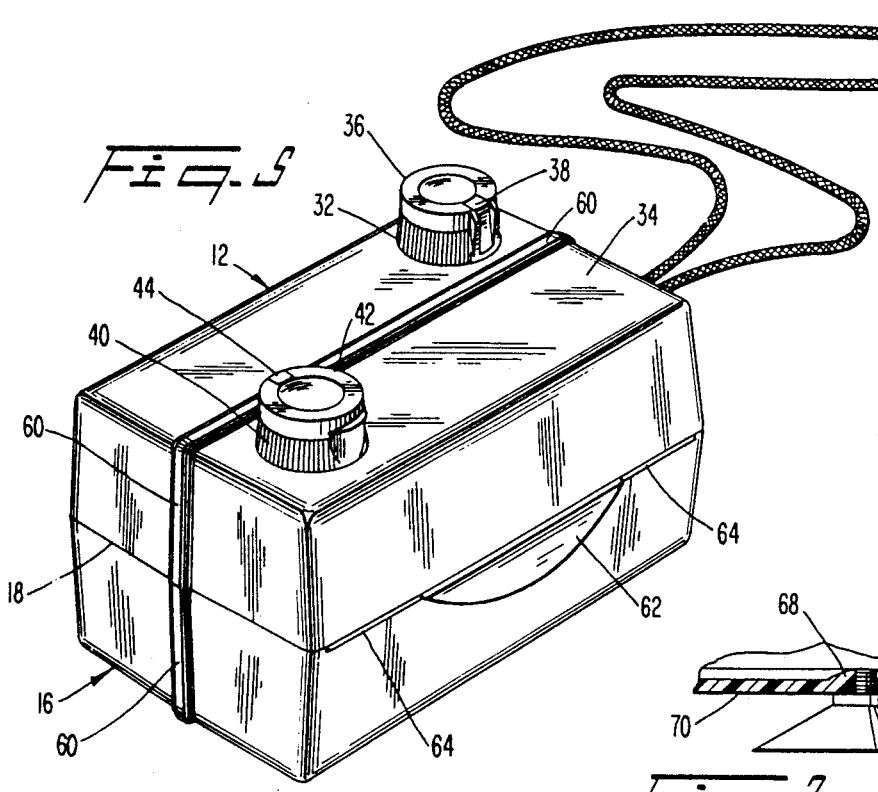
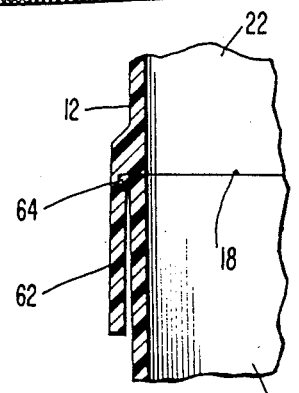
Fig. 6
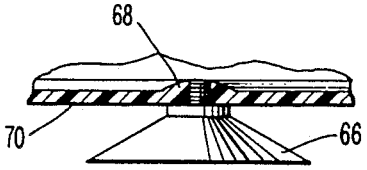
Fig. 7

Fig. 10
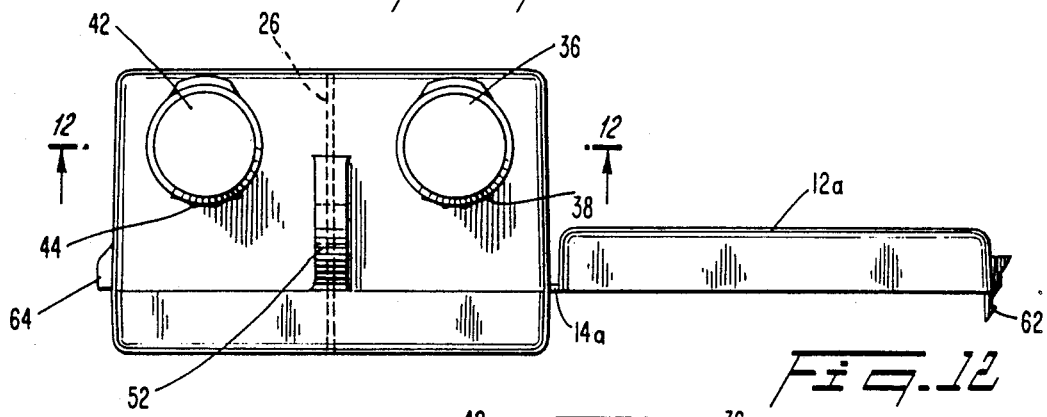
Fig. 11
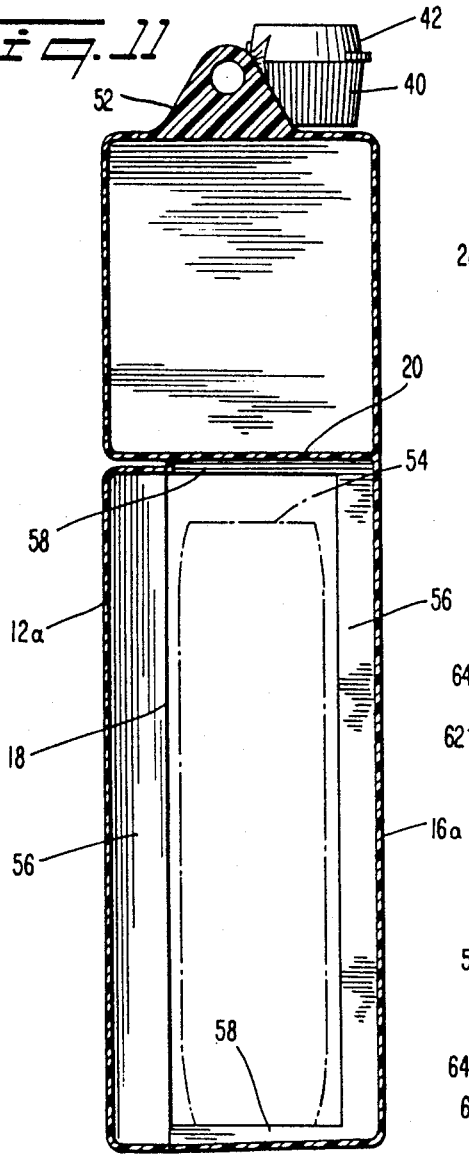
Fig. 12
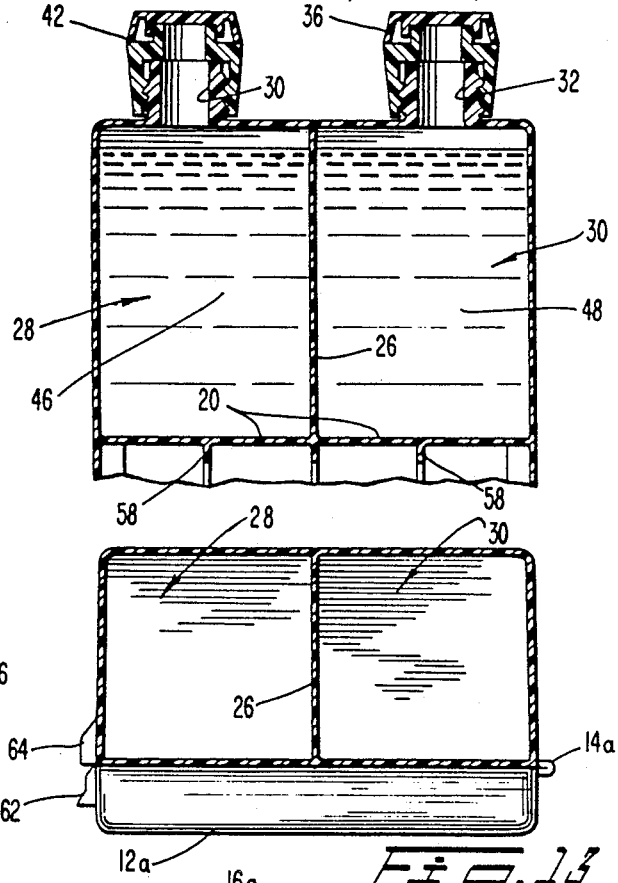
Fig. 13
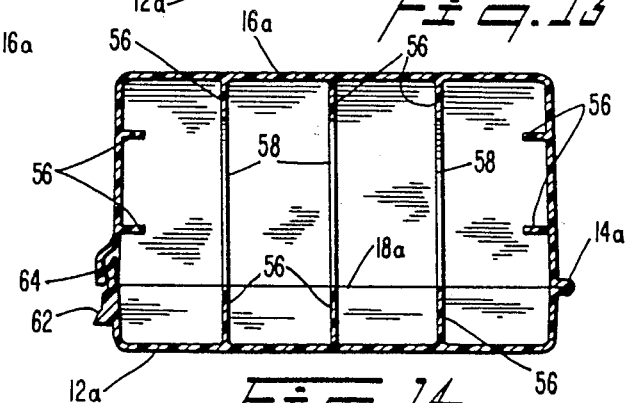
Fig. 14

PARTITIONED CONTAINERS

TECHNICAL FIELD

This invention relates, generally, to containers. More particularly, it relates to a partitioned container that holds plural items of the type needed when showering.

BACKGROUND ART

Many people who want to maintain a regular exercise schedule are turning to fitness centers, YMCA's and other institutions owning facilities equipped with exercise equipment and jogging tracks. The facilities typically have commercial showers; accordingly, the exerciser cannot leave his or her shampoo, soap and other articles in the shower as may be done at home. Thus, it is a common sight at fitness centers to see exercisers entering the showers with their arms full of bottles of shampoo, hair conditioner, soap and the like.

Several inventors have tackled this problem. U.S. Pat. No. 4,611,716 to Sorlien, for example, discloses a compartmented carrying case for holding bottles of shampoo and creme rinse. U.S. Pat. Nos. to Billesbach et al., 3,377,121 and Laconis 4,592,478 are also of interest; they add a cord or hook type handle, respectively. There are many other patents of less interest showing subcompartments, partitions and the like.

An important drawback of the Sorlien carrying case is that it requires the exerciser to carry a plurality of bottles into the shower. When full, the bottles will be quite heavy. Moreover, the carrying case and the bottles must be opened and closed, i.e., two separate opening and closing operations are needed because bottles with caps are carried in a container that also must be opened.

Thus, there is a need for a light in weight container for shower articles that does not require the user thereof to perform two openings and two closings for each article used in the shower, but an article of manufacture that fills these needs does not appear in the art.

DISCLOSURE OF INVENTION

The present invention includes two embodiments, both of which provide a single container having plural subcompartments for shampoo, hair conditioner and soap. The shampoo and hair conditioner are charged into their associated subcompartments from bottles so that no bottles are carried by the exerciser when entering the shower. The soap is held in still another subcompartment, and the entire device is attached to a rope that forms a loop so that the exerciser may drape the novel carrying case around his or her neck.

The invention may be thought of, generally, as a soap dish with a hollow lid; the hollow lid thus defines an enclosed cavity means that is partitioned into subcompartments for shampoo and hair conditioner. The primary object of this invention is to enable a person entering a communal shower to carry needed items in a convenient way. It should be noted, however, that the invention may be used with equal convenience in a home setting as well.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which:

FIG. 4 is a top plan view showing the first embodiment in its open configuration;

FIG. 5 is a perspective view of the first embodiment;

FIG. 6 is a detailed sectional view of the closure means of this invention;

FIG. 7 is a detailed sectional view showing a structural detail of the invention;

FIG. 10 is a top plan view of the embodiment of FIG. 8 in its FIG. 9 position;

FIG. 11 is a longitudinal sectional view taken along line 11—11 in FIG. 8;

FIG. 12 is a transverse sectional view taken along line 12—12 in FIG. 10;

FIG. 13 is a transverse sectional view taken along line 13—13 in FIG. 8; and FIG. 14 is a transverse sectional view taken along line 14–14 in FIG. 8.

Similar reference numerals refer to similar parts throughout the several views of the drawings.

BEST MODES FOR CARRYING OUT THE INVENTION

Figure 1:
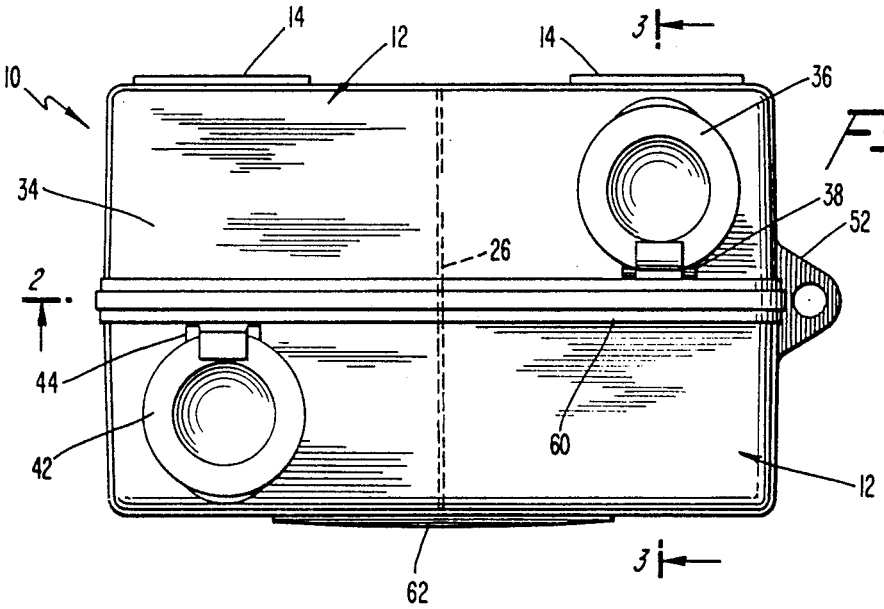
FIG. 1 is a top plan view of a first embodiment of the invention.

Referring now to FIGS. 1–7, it will there be seen that a first embodiment of the present invention is designated by the reference numeral 10 as a whole.

Figure 2:
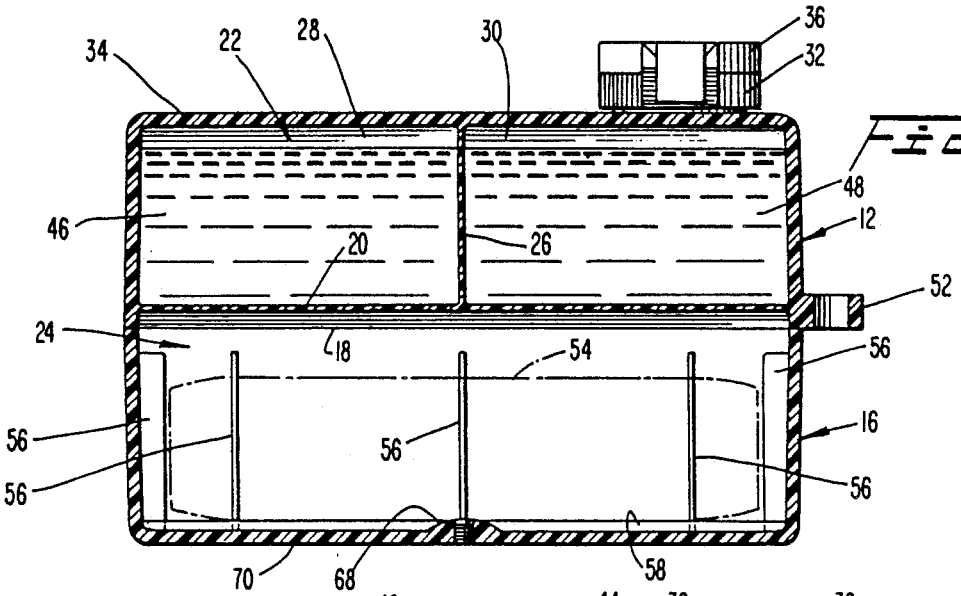
FIG. 2 is a longitudinal sectional view taken along line 2—2 in FIG. 1.

Portable container 10 is of parallelepiped configuration and includes hollow lid 12 connected by hinges 14 to base member 16; the parting line between lid 12 and base member 16 is denoted 18 in FIGS. 2 and 5.

Imperforate partition 20 divides container 10 into an upper chamber, generally denoted 22, and a lower chamber 24. Importantly, partition 20 is positioned above parting line 18, i.e., partition 20 is the bottom wall of hollow lid 12. In other words, bottom wall 20 has first side walls that project upwardly therefrom and second side walls that project downwardly therefrom. The downwardly depending side walls abut a third set of side walls as shown, said third set of side walls projecting upwardly from bottom wall 70 of base 16.

Vertical imperforate partition 26 is traversely disposed as shown and subdivides upper chamber 22 into two subcompartments 28, 30.

Spout 32 is integral to top wall 34 of lid 12 and projects upwardly therefrom on a first side of vertical partition 26; it is closed by closure means 36 which closure means is hingedly secured to spout 32 by hinge means 38 (FIG. 1).

Similarily, spout 40 is also integral to top wall 34 of lid 12 and projects upwardly therefrom on a second side of vertical partition 26; it is closed by closure means 42 which closure means is hingedly secured to spout 40 by hinge means 44. It should be observed that hinges 38 and 44 are positioned on opposite sides of the longitudinal axis of the container so that closure means 36 and 42 open outwardly with respect to said axis.

Spouts 32 and 40 are specifically positioned in opposite corners of lid 12 as shown, to facilitate the pouring of shampoo 46 and hair conditioner 48 from chambers 28, 30 respectively.

Rope 50 (FIG. 5) passes through centrally apertured lug member 52 to form a loop so that container 10 may be conveniently worn about the neck.

Figure 3:
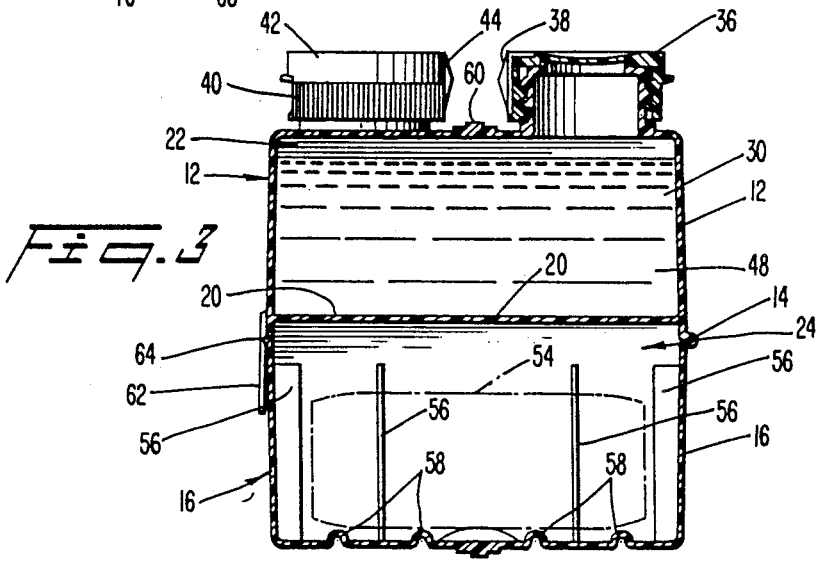
FIG. 3 is a transverse sectional view taken along line 3-3 in FIG. 1.
Figure 9:
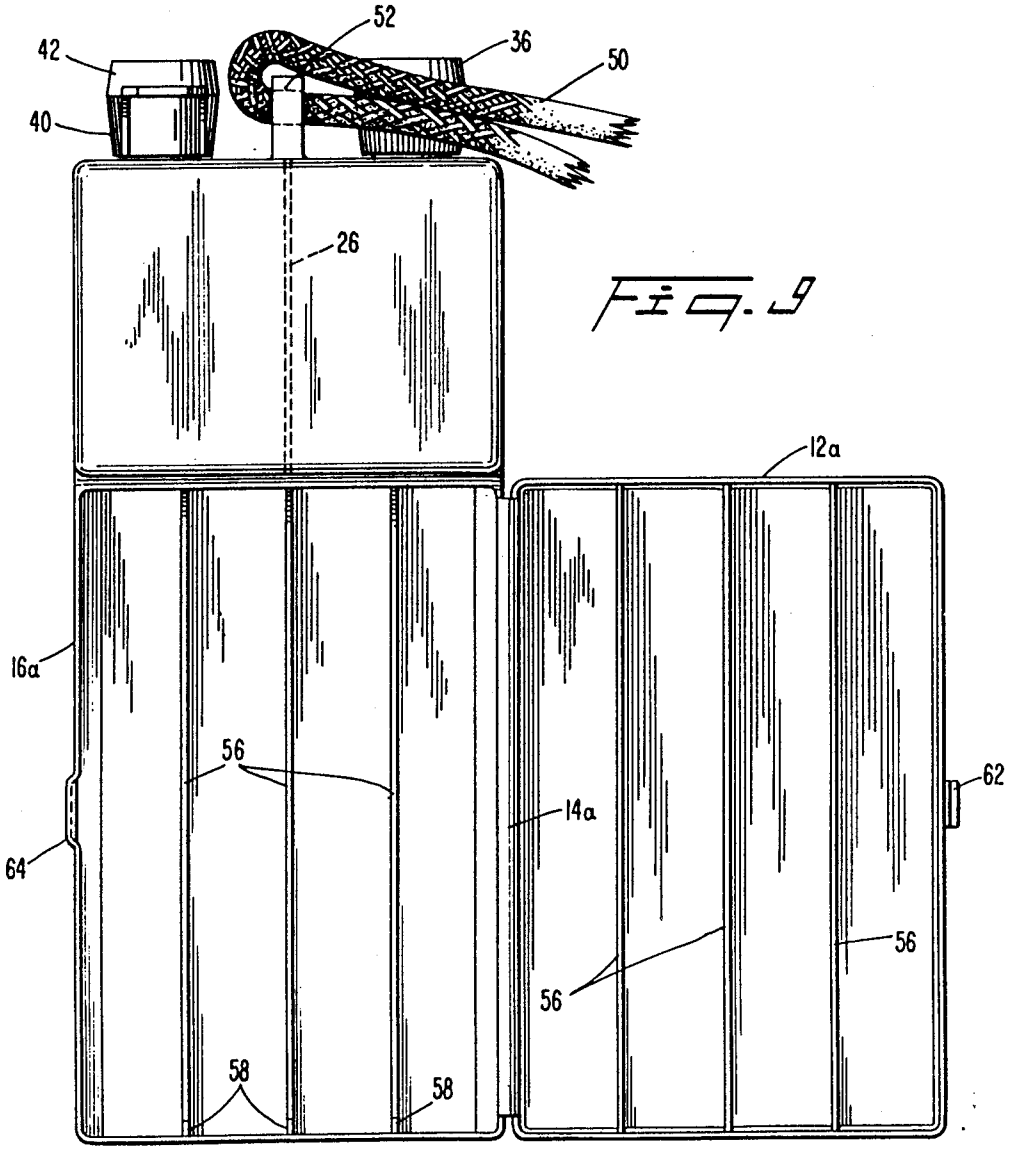
FIG. 9 is a front elevational view of the embodiment of FIG. 8 in its open configuration.
Figure 8:
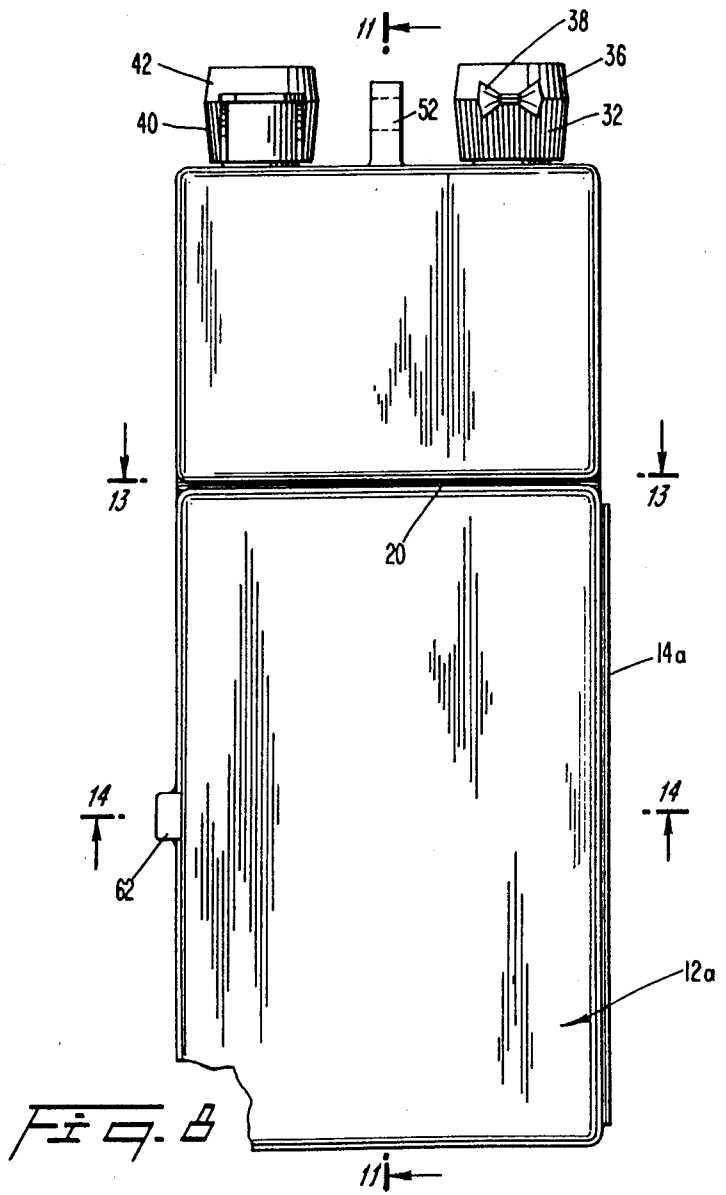
FIG. 8 is a front elevational view of a second embodiment of the invention in its closed configuration.

A bar of soap 54 is positioned in lower chamber 24 when the invention is to be used; it is centered by a plurality of upstanding, inwardly extending wall members, collectively denoted 56, and rests atop plural parallel ridge means 58 as perhaps best depicted in FIG. 3.

Additional structural features include peripheral ridge member 60 that strengthens container 10, flap member 62, integral with lid 12, that snap fittingly engages lip 64, integral to base 16, and a suction cup member 66 that screw threadingly engages boss 68 formed in the bottom wall 70 of base 16.

A different configuration of substantially the same parts appears in FIGS. 8–14. Like parts are denoted by the same reference numerals employed in the first described embodiment; a lower case "a" is appended to the reference numerals indicating parts that do not exactly correspond to the corresponding parts of the first-described embodiment.

In this second embodiment, soap 54 is held on end as perhaps best understood in connection with FIG. 11, and lid **12*a* is associated with the soap-containing part of the device only and is not hollow. The shampoo and conditioner compartments 28, 30, respectively, are, in effect, re-located to the end of the base 16 as perhaps best understood by comparing FIGS. 2 and 11**. Due to the similarity of the two embodiments, the second-disclosed embodiment will not be further described in detail and reference should be made to the reference numerals for a fuller understanding of the structure of this second embodiment.

In both embodiments, the soap dish part thereof defines an open-topped cavity means. In the first embodiment, the open-topped cavity means is closed by the unique hollow lid and in the second embodiment, the open-topped cavity means is conventionally closed but subcompartments for additional toiletry items are uniquely positioned on its end.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A portable container, comprising:

a hollow lid member of parallelepiped construction, said lid member having an imperforate bottom wall of rectangular configuration, first imperforate side walls mounted about the periphery thereof and projecting upwardly therefrom, and a top wall of rectangular configuration, said walls collectively defining a first cavity therebetween;

said lid member further including second imperforate sidewalls mounted about the periphery of said bottom wall and depending downwardly therefrom;

a hollow base member having a bottom wall of rectangular configuration and third imperforate side walls mounted about the periphery thereof and projecting upwardly therefrom, said third side walls defining an upwardly opening second cavity therebetween;

a hinge for hingedly interconnecting said lid member and said base member;

an imperforate, transversely disposed upstanding partition wall that divides said first cavity into a first and a second subcompartment, said partition wall extending between said lid member bottom wall and said lid member top wall and said partition wall being coincident with a transverse axis of symmetry of said container;

said container having a longitudinal axis of symmetry;

a first and second aperture means formed in said top wall, on opposite sides of and in equidistantly spaced relation to said partition wall and on opposite sides of said longitudinal axis of symmetry;

a first and a second spout means mounted about the periphery of each of said first and second aperture means, respectively, and projecting upwardly therefrom;

a first and second closure means associated with said first and second spout means, respectively, for selectively closing said first and second spout means;

a first hinge for hingedly interconnecting said first closure means and said first spout means;

a second hinge for hingedly interconnecting said second closure means and said second spout means;

said first and second hinges being parallel to and in closely spaced relation to said longitudinal axis of symmetry so that said first and second closure means open in opposite directions relative to said longitudinal axis of symmetry;

a parting line substantially circumscribing said container where said second and third side walls abut one another when said lid member is in its closed position relative to said base member; and said hinge interconnecting said lid member and base member being disposed coincident with said parting line.

2. The container of claim 1, wherein said aperture means are formed in respective corners of said lid member top wall.

3. The container of claim 2, wherein said second cavity means has a size sufficient to receive a bar of soap therein.

4. The container of claim 3, further comprising a container-strengthening peripheral ridge member that longitudinally circumscribes said container.

5. The container of claim 4, further comprising a flap member integral with said lid member and a lip member integral with said base member, said flap member being adapted to releasably engage said lip member to selectively secure said lid member to said base member when the container is closed.

6. The container of claim 5, further comprising a centrally apertures lug member integral to said lid member at a preselected end thereof for suspending said container upon a rope extending through said central aperture.

* * * * *